US005188365A

United States Patent [19]

Picard

[11] Patent Number: 5,188,365

[45] Date of Patent: Feb. 23, 1993

[54] GOLF SWING TRAINING HARNESS

[75] Inventor: Richard Picard, Langley, Canada

[73] Assignee: Rachel-Mae Industries Inc., Langley, Canada

[21] Appl. No.: 746,927

[22] Filed: Aug. 19, 1991

[51] Int. Cl.[5] ..... A63B 69/36

[52] U.S. Cl. ..... 273/189 R; 273/188 A

[58] Field of Search ..... 273/183 B, 188 R, 188 A, 273/189 R, 189 A, 190 R, 190 A, 190 B, 191 R, 191 A, 191 B, DIG. 30; 272/143, 135, 125, 67; 128/157

[56] References Cited

U.S. PATENT DOCUMENTS

| | | | |
|---|---|---|---|
| 2,773,691 | 12/1956 | Redfield . | |
| 3,188,090 | 6/1965 | Job . | |
| 3,314,421 | 4/1967 | Wingard | 128/157 |
| 3,680,869 | 8/1972 | Brady | 273/183 B |
| 3,740,052 | 6/1973 | Arkin . | |
| 3,804,420 | 4/1974 | Boyd | 273/189 R |
| 4,239,228 | 12/1980 | Norman et al. . | |
| 4,359,221 | 11/1982 | Taylor | 273/189 R |
| 4,892,317 | 1/1990 | Corder, Jr. | 273/189 R |
| 4,955,608 | 9/1990 | Dougherty et al. | 273/188 R |
| 5,048,836 | 9/1991 | Bellagamba | 272/143 |

FOREIGN PATENT DOCUMENTS

| | | | |
|---|---|---|---|
| 0020463 | of 1907 | United Kingdom | 273/189 R |
| 0180599 | 6/1922 | United Kingdom | 273/189 R |

OTHER PUBLICATIONS

Advertisement of SwingLink, by golf instructor David Leadbetter.

*Primary Examiner*—Benjamin H. Layno
*Assistant Examiner*—Steven B. Wong
*Attorney, Agent, or Firm*—Chernoff, Vilhauer et al.

[57] ABSTRACT

This invention pertains to a novel golf swing training harness. More particularly, this invention relates to a novel harness which can be secured to the forward knee, forward wrist, rear elbow, and waist of a golfer to encourage the golfer to keep his or her limbs in correct position as the golfer proceeds through a grooved golf swing. A golf swing training harness for wear by a golfer comprising: (a) waist fitting member adapted to be fitted to the golfer's waist area; (b) elbow fitting member for releasably securing to an elbow of a golfer; (c) wrist fitting member for releasably securing to wrist of a golfer; (d) resilient strap for releasably securing the elbow fitting member to the waist fitting member and (e) resilient strap for releasably securing the wrist fitting member to the waist fitting member.

9 Claims, 3 Drawing Sheets

GOLF SWING TRAINING HARNESS

FIELD OF THE INVENTION

This invention pertains to a novel golf swing training harness. More particularly, this invention relates to a novel harness which can be secured to the forward knee, forward wrist, rear elbow, and waist of a golfer to encourage the golfer to keep his or her limbs in correct position as the golfer proceeds through a grooved golf swing.

BACKGROUND OF THE INVENTION

Golf is a highly popular worldwide source of exercise and recreation for persons of all ages and levels of skill. To become proficient in the game, and card scores at a par or bogie level, it is necessary for the golfer to develop a precision swing so that he or she can accurately strike the ball with the wood or iron in order to propel the ball in the desired line of flight toward the hole. Much has been written over the years on developing a good golf swing. Many professional teachers spend their career teaching persons to develop a grooved golf swing. Numerous video lessons are also available directed to teaching a golfer how to develop a precision golf swing.

A number of inventions have been developed over the years for the purpose of assisting a golfer to develop a precision swing. Four U.S. patents disclose various types of harnesses or limb guiding means intended to assist a golfer in developing a precision golf swing.

U.S. Pat. No. 2,773,691, granted Dec. 11, 1956, F. E. Redfield, discloses a harness device for guiding the movement of the rear elbow during a golf back-swing. The device includes a belt adapted to encircle the waist of the player. A guide rail is secured to the belt. The guide rail extends substantially from the centre of the abdomen upwardly and rearwardly relative to the waist. The guide rail provides a means for guiding a trolley member, to which is attached an armband or loop member which encircles the rear arm of the player in the elbow region. The trolley member follows the guide rail throughout its length. The arm band and waist belt can be reversed to accommodate a left-hand golfer. One object of the guiding means is to provide guidance during pre-selected critical portions of the golf stroke. Another object is to prevent the right or rear elbow of a right-handed player, or conversely the left elbow of a left-handed player, from "flying", that is, being displaced an improper distance from the torso and waist during the back-swing and down-swing portions of the golf stroke. Redfield does not disclose any attachments that fasten to the forward arm or forward leg of the golfer.

U.S. Pat. No. 3,188,090, L. E. Job, granted Jun. 8, 1965, discloses an arm restraining device for golfers. The golf swing trainer comprises a body harness, and a thong connected to the body harness at a point near the armpit of the right arm of a right-handed golfer and to an attachment adapted to be fitted to the hand or wrist of that arm, the length of the thong being such that when the player is addressing the ball, the elbow of that arm is maintained slightly bent. An objective of the trainer is to prevent the tendency during a golf swing to straighten the right elbow in an attempt to put more force into the stroke with the right hand on the down-swing. The trainer prevents undue straightening of the right elbow without hindering the swing during the back-swing and down-swing portions of the golf stroke. No devices are secured to the forward leg of the golfer to control the movement of that leg during the golf swing.

U.S. Pat. No. 3,740,052, P. E. Arkin, granted Jun. 19, 1973, discloses a golf practice device which comprises an elastic member which is adapted to be attached to the forearm of a golfer so that the arm is held straight against bending during the back-swing and down-swing aspects of the golf swing. The golf practice device includes a length of flexible cord, including a clamp at each end thereof. The clamps are adapted to engage the cord at any position along the length in order to form a loop at each end of the cord. The first loop encircles the area of a golfer's shoulder, travels across the golfer's back, around the golfer's forearm, and to a second loop encircling the joint between the thumb and adjacent finger of the hand of the golfer's other arm. The device does not utilize a strap which is secured to the foreknee of the golfer.

U.S. Pat. No. 4,239,228, B. F. J. Norman et al., granted Dec. 16, 1980, discloses a golf swing training device which includes an adjustable tether for joining the upper arms of a golfer in order to coordinate the relative motion of the arms of the golfer during the back-swing and down-swing stages of the golf stroke. The arm joining tether includes first and second flexible straps which include hook and pile fasteners in order to secure the straps around the arms of the golfer. The restraint device is alleged to be useful during golf practice for training the golfer to coordinate the relative movements of his arms during his stroke. No tethers are secured to either of the legs of the golfer.

David Leadbetter, Director of Instruction at Lake Nova Golf Club in Orlando, Fla. markets a restraining strap under the trade-mark SWING LINK. This strap has a chest band and two arm bands connected to the chest band. The bands are adjustable in length, and are worn around the chest and upper arms of the golfer. The objective is to restrain the upper arms against the chest of the golfer in order to encourage a tight, controlled swing. No resilient connecting straps between the chest band and the arm bands are used.

SUMMARY OF THE INVENTION

The invention is directed to a golf swing training harness for wear by a golfer comprising: (a) means adapted to be fitted to the golfer's waist area; (b) elbow means for releasably securing to an elbow of a golfer; (c) wrist means for releasably securing to a wrist of a golfer; (d) resilient means for releasably securing the elbow means to the waist means; and (e) resilient means for releasably securing the wrist means to the waist means. The harness may include leg means for releasably securing to a leg of a golfer and resilient means for securing the wrist means to the leg means.

The wrist means, elbow means and leg means of the harness may be circular, and the circumference of the waist means, wrist means, elbow means and leg means may be adjustable. The lengths of the resilient means may be adjustable.

The waist means may be a belt. The elbow, wrist means and leg means may be equipped with hook and pile fasteners. The position of securement of the resilient means (e) to the waist means and the resilient means (f) to the waist means may be moveable.

A diagonal traveller can be secured to the waist means and the resilient means (d) can travel along the length of the traveller. An adjustable length crotch strap can be secured to the waist means.

BRIEF DESCRIPTION OF THE DRAWINGS

In drawings which represent specific embodiments of the invention but which should not be construed as restricting or limiting the scope of the invention in any way.

DETAILED DESCRIPTION OF SPECIFIC EMBODIMENTS OF THE INVENTION

Figure 1:
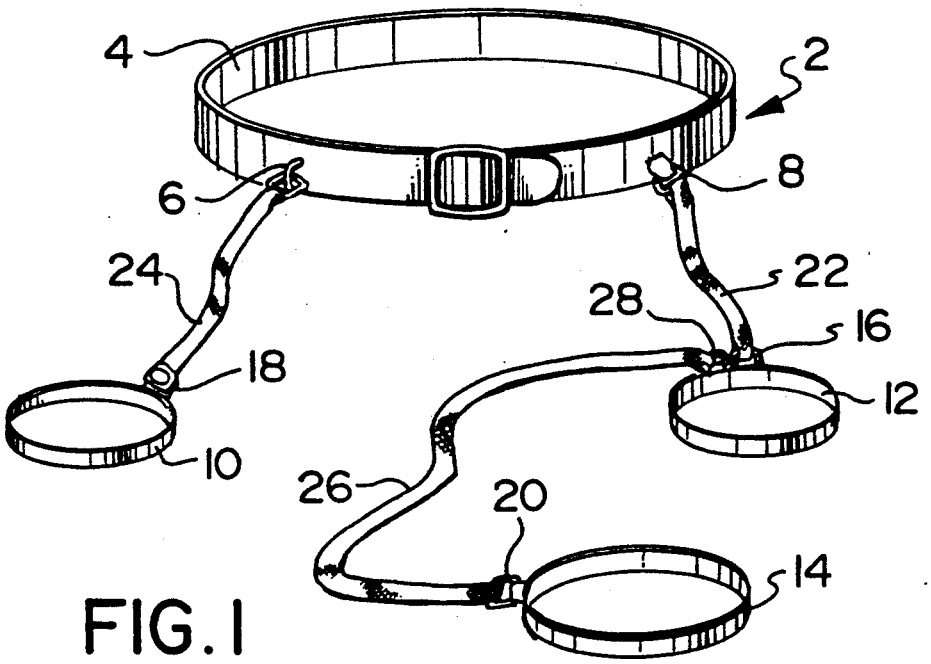
FIG. 1 illustrates an isometric view of the golf swing training harness.

Referring to FIG. 1, which illustrates an isometric view of the golf swing training harness 2, the harness 2 is constructed of a removable adjustable size belt 4, which can be fitted about the waist of a golfer. The belt 4 has located at each side of the front area thereof, a first belt loop 6 and a second belt loop 8. An adjustable length elbow band 10 is connected to first belt loop 6 by an elastic elbow-belt extensor 24, and elbow bend loop 18, attached to the band 10.

An adjustable length wrist band 12 is connected to second belt loop 8 by means of a wrist band loop 16 and elastic wrist-belt extensor 22. Connected to wrist band 12 by means of a second wrist band loop 28, secured to band 12, is an adjustable length leg band 14. Leg band 14 is connected to second wrist band loop 28 by means of leg band loop 20 and adjustable length elastic leg-wrist extensor 26.

Belt 4 can be formed of any suitable flexible reasonably stiff material, and can be fitted with suitable securing devices such as a belt buckle, or other suitable connecting means, in order to enable the circumference of the belt to be lengthened or shortened in order to accommodate the waist size of a particular golfer.

Elbow band 10, wrist band 12 and leg band 14 can also be formed of any suitable flexible adjustable length material in order to accommodate the elbow, wrist and leg circumference sizes of the particular golfer to which the harness is to be fitted. In one specific embodiment, elbow band 10, wrist band 12, and leg band 14 can be formed of a flexible material fitted with a conventional hook and pile fastener combination (Velcro TM fastener) so that the circumference of the respective band can be readily shortened or lengthened as the case may be to fit the respective elbow, wrist or leg of the golfer.

Wrist-belt extensor 22, elbow-belt extensor 24 and leg-wrist extensor 26 are formed of suitable flexible elastic materials so that they can stretch or contract during the back-swing, down-swing and the follow-through stages of the golf stroke. Also, the lengths of wrist-belt extensor, elbow-belt extensor 24 and leg-wrist extensor 26 can be lengthened or shortened in order to fit the body shape of the particular golfer who is to wear the harness. Adjustments in length can also be made by means of wrist-band loop 16, elbow band loop 18 and leg band loop 20, if desired. Loops 6, 8, 16, 18, 20 and 28 can be replaced if required with some other suitable adjustable securing means.

Figure 2:
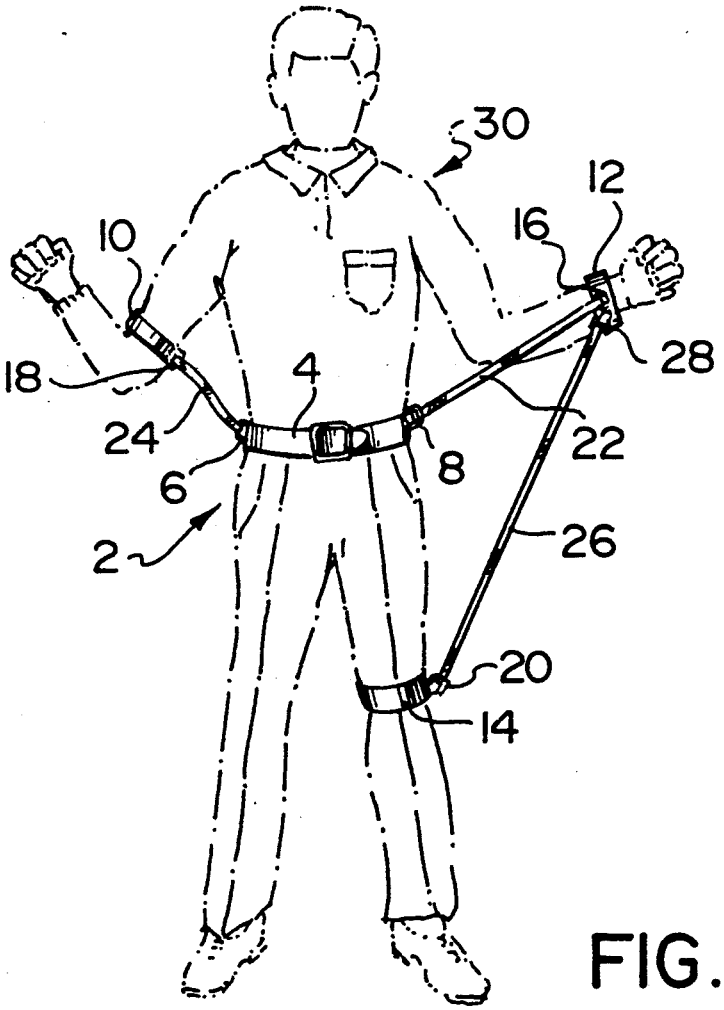
FIG. 2 illustrates a front view of a person wearing the golf swing training harness.

FIG. 2 illustrates a front view of a golfer 30 wearing the golf swing training harness 2. As can be seen, the belt 4 is fitted about the waist of the golfer 30. As seen in FIG. 2, the harness 2 is arranged for a golfer 30 who has a right-hand swing. The harness 2 can be modified easily to accommodate a left-hand swing golfer simply by reversing the various components.

For a right-hand swing golfer, first belt loop 6 is secured to the right side of the belt 4 (left side as seen in FIG. 2). The elbow band 10 is secured immediately above the right elbow of the golfer 30. The elbow-belt extensor 24 extends from elbow band loop 18 and band 10 to first belt loop 6.

Second belt loop 8 is secured to the left side (right side as seen in FIG. 2) of the belt 4. Wrist band 12 is connected to second belt loop 8 by means of first wrist band loop 16 and elastic wrist-belt extensor 22.

Leg band loop 20 is fitted to the left thigh of the golfer 30 immediately above or below the knee. Leg band 14 is connected by leg band loop 20 and elastic leg-wrist extensor 26 to the second wrist band loop 28 of waist band 12. The circumferences of the belt 4, the elbow band 10, the wrist band 12, and leg band 14 are adjustable in size and adapted to snugly encircle the respective right elbow, left wrist and left knee area of the golfer 30. Likewise, the lengths of wrist belt extensor 22, elbow-belt extensor 24 and leg-wrist extensor 26 are adjusted to fit the height and limb length of the golfer 30.

Figure 3:
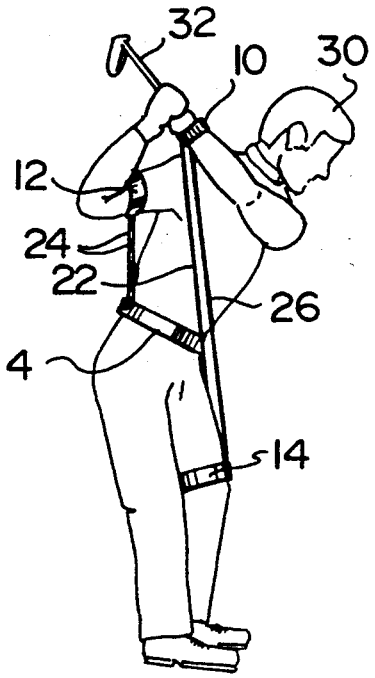
FIG. 3 illustrates a rear view of a golfer at the top of a back-swing wearing the golf swing training harness.

FIGS. 3, 4, 5 and 6 show sequential rear views of a right-handed golfer proceeding from the top of the back-swing down through the down-swing, and finally the follow-through, after striking a golf ball (not shown) with the golf club 32. At the top of the back-swing, as illustrated in FIG. 3, the elbow-belt extensor 24 holds the right elbow of the golfer 30 in place close to the torso, thereby deterring the well-known fault phenomena in a golf swing of a "flying elbow". Similarly, wrist-belt extensor 22 encourages the stiff left arm of the golfer to remain "tight" at the top of the back-swing, rather than being too far back or too far forward, both of which are well known faults in the back-swing of a golfer. Likewise, leg-wrist extensor 26 encourages the left knee of the golfer, during the back-swing, to move inwardly and rearwardly, thereby ensuring that most of the weight of the golfer during the back-swing is transferred to and absorbed by the right leg. When proceeding through the back-swing, a golfer need only concentrate on ensuring that his head remains stationary, the left arm remains relatively straight and firm, and the weight is rotated around the torso in the direction of the back-swing. The elasticity of the extensors 22, 24 and 26 also prompts the golfer to maintain a tight controlled back-swing and to stay "down" during the back-swing, which is a desirable objective. The golf swing training harness 2 thus encourages all of these important and desirable aspects of a good precision golf back-swing, thereby enhancing the likelihood that the golfer will strike the ball accurately at the bottom of the back-swing.

Figure 4:
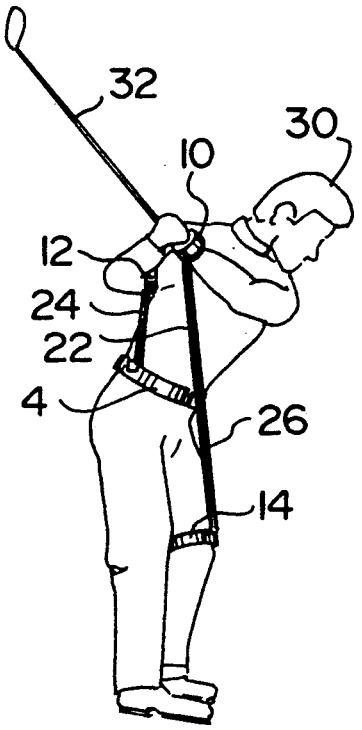
FIG. 4 illustrates a rear view of a golfer in the down-swing stage wearing the golf swing training harness.

In FIG. 4, the golfer is depicted during the upper stage of his down-swing. As the golfer rotates into the down-swing, the left arm is brought forwardly and downwardly. Likewise, the weight of the golfer is transferred by hip rotation to the left leg in order to generate power in the stroke. Leg-wrist extensor 26 relieves the tension on the left knee of the golfer as the left arm is moved downwardly and forwardly during the down-swing. Elbow-belt extensor 24 encourages the right elbow of the golfer to remain tucked relatively close to the torso of the golfer, thereby preventing flying elbow during the down-swing.

In order to develop power and ensure a good "long ball", it is important during the down-swing for the golfer to "drive" his or her hips through the swing. Most of the power in a golf swing is generated by the legs and hips of the golfer, rather than by arm action alone. Wrist-belt extensor 22, by being secured to the left hip area of the golfer, is relieved in tension somewhat as the left arm of the golfer proceeds downwardly and forwardly during the down-swing. This relief in tension encourages the golfer to move his left hip forward and into the golf swing during the down-swing process.

Figure 5:
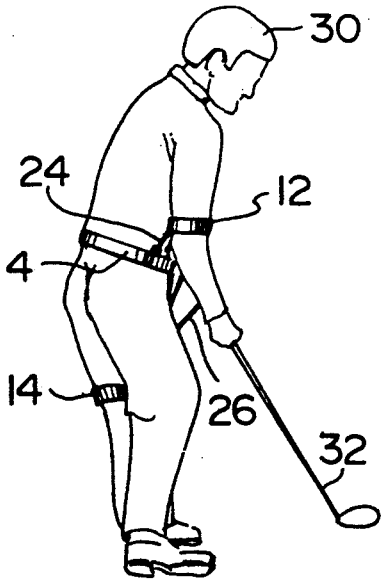
FIG. 5 illustrates a rear view of a golfer immediately after ball impact wearing the golf swing training harness.

FIG. 5 illustrates a rear view of the golfer 30 immediately after impacting the ball (not shown). As can be seen, the hips of the golfer have been rotated well to the forward position, while at the same time, the bulk of the weight of the golfer has been transferred to the right leg. In order to an undesirable "slice" (which is a ball that curves sharply to the right as seen from the perspective in FIGS. 3 to 6), it is important that the trajectory of the golf club 32 proceed through an "inside-outside arc", during the down-swing and at ball impact. This is done by ensuring that the right elbow of the golfer remains snug to the torso of the golfer, and the hips are rotated forwards. During this aspect of the golf swing, elbow-belt extensor 24 encourages the right elbow of the golfer to remain snug. In this way, the golfer is more likely to hit a straight or a desirable "draw" shot, rather than an undesirable slice.

Figure 6:
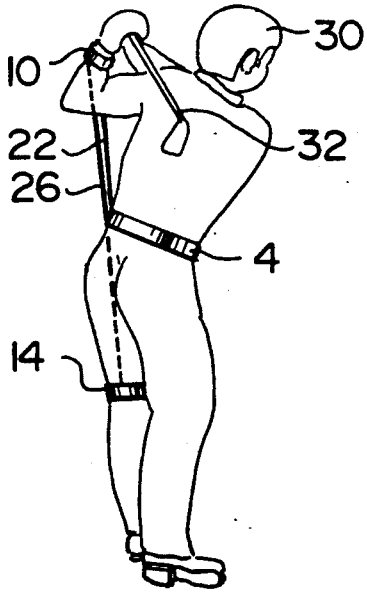
FIG. 6 illustrates a rear view of a golfer at the top of the follow-through position wearing the golf swing training harness.

During the follow-through, as depicted in FIG. 6, wrist-belt extensor 22, elbow-belt extensor 24 (not visible) and leg-wrist extensor 26, still function through their elasticity to encourage the golfer to maintain compact, tight control over the swing. This prevents a lazy or erratic follow-through, which is to be discouraged, notwithstanding that the ball is already in flight. Loose or erratic follow-throughs are usually symptomatic of some earlier fault in the back-swing or down-swing portion of the golf stroke.

As can be seen in the sequence depicted in FIGS. 3 to 6 inclusive, the harness 2 with extensors 22 and 24 encourages the right-swinging golfer 30 to keep the right elbow close to the torso, and forces the stiff left arm to make a proper tight controlled arc as the golfer rotates his body during the back-swing. Meanwhile, leg-wrist extensor 26 encourages the golfer 30 stay down and to shift the weight from the left leg during the back-swing, and transfer the weight back to the left leg on the down-swing.

The harness depicted in FIGS. 1 through 6 inclusive is only one specific version of the invention. The harness can be modified as required to accommodate various situations and objectives. One modification would be to substitute a somewhat stiffer belt equipped with a horizontal or angled traveller element at the front of the belt.

Figure 7:
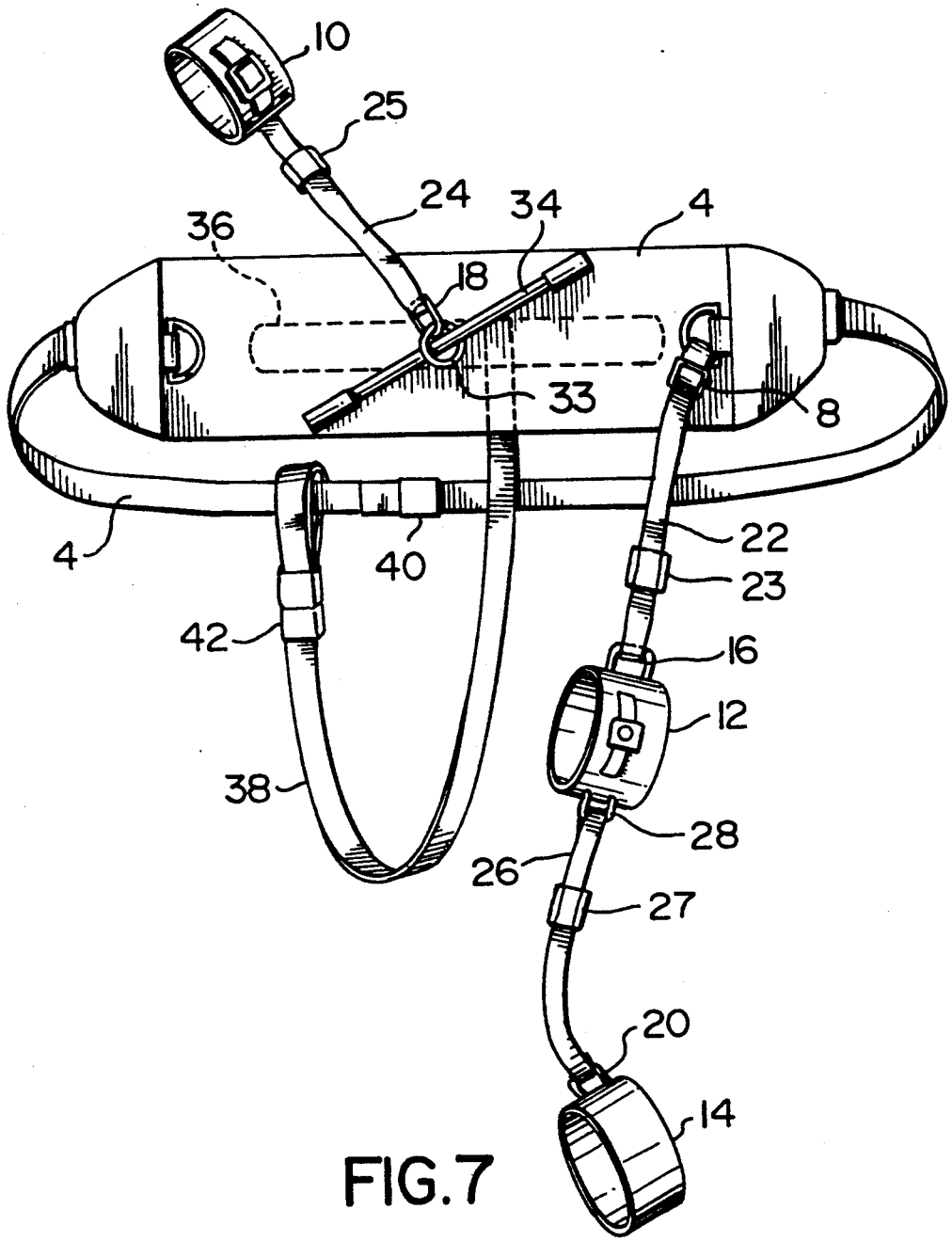
FIG. 7 illustrates an isometric view of an alternative embodiment of the golf swing training harness.

An alternative harness design along these lines is illustrated isometrically in FIG. 7. The belt 4 is wider at the front and carries a diagonal traveller 34. The elbow band 10 is connected by elbow-belt extensor 24, and press snap 25, and ring 33 to traveller 34. Traveller 34 permits ring 33 to travel to the right (as seen in FIG. 7) at the follow-through of the swing, thereby enabling the golfer to take a fuller follow-through. At the top of the backswing, the ring 33 is at the left of the traveller 34. The lengths of extensor 22, 24 and 26 can be quickly adjusted and fixed by using press snaps 23, 25 and 27 respectively.

FIG. 7 also shows a stiffener 36 (in dotted lines) at the rear-side of belt 4. This feature is optional. Some golfer's swings may be improved by utilizing a stiff front to the belt 4. FIG. 7 also illustrates an optional crotch strap 38, with bayonet buckle 42, which are designed to hold the belt 4 in place throughout the swing. In some cases, the belt 4 can ride around or up the waist of the golfer during the swing. Belt 4, at the rear side, can also be fastened quickly using bayonet buckle 40.

The traveller can be designed to permit the elbow band 10, extensor 2A, belt connection 6, to move slightly as the swing progresses, or be fixed. This traveller feature may be desirable if the proper elastic tension for the elbow-belt extensor cannot be achieved, or the golfer or teacher wants to achieve varying extensor tensions during the golf swing, or a fuller follow-through is to be achieved. The loop 6 can be secured in fixed position at any point along the traveller, if desired. In another version, the stiffened belt can be equipped with reversible fittings in the traveller and all connecting loops, so that the belt can be readily switched to fit either a left-hand swing or right-hand swing golfer.

The stiffened belt can be provided on its inner surface with extended flat plastic prongs that can engage belt loops on trouser tops of the golfer. In certain cases, it may be possible to eliminate the belt and simply fasten the various extensors to the trousers of the golfer, or to some alternative waist encircling device.

In another modification, the leg band 14 can be fastened either above or below the left knee of a right-handed golfer, and extensor 26 length adjusted accordingly, if the golfer is not adept at shifting his left foot weight during the back-swing, down-swing and follow-through portions of the golf swing.

EXAMPLE

In discussions with Dr. John Dickinson, Chairman, School of Kinesiology, Simon Fraser University, Burnaby, British Columbia, Canada, it was decided that it would be feasible to evaluate whether use of the harness improved a golfer's performance, physically or mentally. The evaluation was conducted by Mr. Tony Leyland, B.Ed., M.Sc., School of Kinesiology, Simon Fraser University.

1. METHODOLOGY

1.1 Study Design

The design of this study required two groups of golfers to perform two identical tests of golfing skill two weeks apart. Between these two tests one experimental group trained with the golf harness (treatment) and the other group trained without the harness (control). Both groups were given identical instructions on the amount of training time. Differences between pre-training and post-training test scores were calculated and analysed to see if training with the golf harness improved performance more than training without the harness.

1.2 Testing

The test required subjects to hit 10 to 20 practice balls as a warm-up prior to recording scores. Subjects then hit 15 seven-irons and 15 three-woods at a target area. Balls were hit from the second tier of the driving range and the target area was marked out with cones and brightly coloured surveying ribbon to allow subjects a better view of where their balls landed.

Subjects worked in pairs and scored each ball on distance, location and quality of contact. Distance was recorded at the point where the ball landed by observation of both golfers. The location (accuracy) where the ball landed in the target areas determined by both golfers was also recorded. In addition, after each swing the hitting golfer gave his partner subjective feedback as to the quality of the contact he felt he had made with the ball. This was also recorded on the score sheet.

Subjects were asked to perform both the pre- and post-training tests at the same time of day, hit the same number of practice balls prior to both tests, and use the same clubs. Every attempt was made to keep factors that would influence the golf swing constant on both test days.

1.3 Training

Training consisted of hitting 30 to 40 more balls after the initial training session and a further four large buckets (approximately 300 balls) over the two week period between tests. Subjects were requested to golf a maximum of three times during these two weeks (preferably two) and keep additional training to a minimum. The group that trained with the harness received instruction on how to use it after the initial test. The inventor of the harness gave this instruction. The principle investigator, Mr. Tony Leyland, informed subjects that he was an independent evaluator and was not prepared to discuss his position regarding the effectiveness of the device.

1.4 Hypotheses

The following hypotheses were developed:

A. Training with the test harness will increase the distance for any given club, compared with a similar amount of training without the harness.

B. Training with the test harness will increase the accuracy, compared with a similar amount of training without the harness.

C. Training with the test harness will increase the number of solid contacts with the ball, compared with a similar amount of training without the harness.

D. Training with the test harness will improve the consistency (lower standard deviation on scores) of distance, accuracy and quality of contact, compared with a similar amount of training without the harness.

1.5 Data Analysis

The three measured parameters of distance, location and contact were recorded for the pre- and post-training tests. Six measures were then evaluated and analysed using SPSX statistical software. The six measures were change (improvement) in: (1) distance; (2) variability in distance; (3) location; (4) variability in location; (5) contact; and (6) variability in contact. The variability (measured as standard deviation) of the three parameters was analysed because the key to a good golf swing is not an occasional exceptional shot, but the ability to consistently reproduce an adequate swing. Even if training with the harness did not improve distance, improvement in the consistency with which the ball is struck would be a desirable outcome.

2. SUBJECTS AND GROUPINGS

Volunteers were requested from the clientele at Langley Golf Centre, Langley, British Columbia, Canada. These volunteers were all male and their self-reported golf handicaps ranged from 7 to 30 (average 21). The volunteers were divided into pairs matched by handicap. One of the pair was placed randomly into the control group, the second into the treatment group. Each group had 21 subjects.

The initial testing day was May 11, 1991, at the Langley Golf Centre. Of the 42 subjects selected, 35 participated (19 in one group, 16 in the other). The second testing day was held two weeks later (May 25, 1991). Results from subjects who failed to comply with the test protocol were discarded. The number of test scores submitted for analysis were: 17 in the treatment group and 15 in the control group. The average handicaps of these two groups were 21.4 and 20.3, respectively.

All subjects were required to sign a non-disclosure agreement and a medical release form prior to commencing the test. None of the subjects refused to participate due to these requirements.

3. RESULTS

3.1. External Factors

The weather on the second testing day was quite inclement which possibly affected results. In particular, a strong wind blew into the faces of test subjects on the second testing day which reduced the flight distance for balls.

3.2 Test Results

Results for the seven-iron and three-wood are shown in Tables 1 and 2, respectively. The results show the average value and average standard deviation for distance, location and contact. As standard deviation is a measure of the variability, these parameters are described as variation in distance, location and contact.

Distance is measured in yards as golf courses rarely use the metric system of measurement. Location was recorded for analysis as follows: a centre hit was coded 1; a slightly off-centre hit was coded 2 (left and right); and a far off-centre hit was coded 3 (left and right). Therefore, an average of 1 on this score would be a perfect score, with worse scores increasing in value towards 3. Similar to location, an average of 1 for contact is a perfect score and values increasing towards 4 are worse.

The difference column in Tables 1 and 2 (post-training results minus pre-training results) indicates the amount of improvement or decrement in the test scores. A positive difference in distance would indicate improvement (i.e. more distance). On the other hand, a negative difference in all other scores indicates improvement. This is because a lower post-training score in location and contact indicates more centre hits and solid contacts, respectively. Less variation (standard deviation) in the other results indicates a more consistent golf swing.

As stated, the weather on the second day resulted in distance being reduced. However, for both the 7-iron and 3-wood trials, the treatment group had less decrement than the control group, indicating an improvement. The other measures appeared less affected by the weather and revealed no difference between treatment group and control group on pre- and post-training tests.

3.3 Statistical Analysis

Twelve two-sample T-tests were performed on SPSX statistical software. Only one statistical difference was found between the treatment and control groups. The treatment group had a lower variability in the distance they hit their 3-wood in post-training tests than in pre-training tests. This indicates they were striking the ball more consistently than the group who trained without the harness.

3.4 Opinion

After completing the tests, the golfers using the harness were asked whether it improved their swing. 70.6 percent replied that the harness had improved their swing.

TABLE 1

SEVEN-IRON
PRE- AND POST- TRAINING TEST SCORES

| | CONTROL GROUP | | | TREATMENT GROUP | | |
|---|---|---|---|---|---|---|
| | PRE- | POST- | DIFFERENCE | PRE- | POST- | DIFFERENCE |
| DISTANCE | 123 | 115 | −8 | 120 | 116 | −4 |
| VARIATION IN DISTANCE | 17 | 15 | −2 | 20 | 19 | −1 |
| LOCATION | 1.7 | 1.7 | 0.0 | 1.7 | 1.9 | 0.2 |
| VARIATION IN LOCATION | 0.7 | 0.7 | 0.0 | 0.7 | 0.7 | 0.0 |
| CONTACT | 1.8 | 1.6 | −0.2 | 1.7 | 1.7 | 0.0 |
| VARIATION IN CONTACT | 0.8 | 0.7 | −0.1 | 0.8 | 0.8 | 0.0 |

TABLE 2

THREE-WOOD
PRE- AND POST- TRAINING TEST SCORES

| | CONTROL GROUP | | | TREATMENT GROUP | | |
|---|---|---|---|---|---|---|
| | PRE- | POST- | DIFFERENCE | PRE- | POST- | DIFFERENCE |
| DISTANCE | 162 | 153 | −9 | 159 | 156 | −3 |
| VARIATION IN DISTANCE | 21 | 26 | 5* | 35 | 26 | −9* |
| LOCATION | 1.8 | 1.8 | 0.0 | 1.8 | 1.9 | 0.1 |
| VARIATION IN LOCATION | 0.8 | 0.8 | 0.0 | 0.7 | 0.8 | 0.1 |
| CONTACT | 1.8 | 1.7 | −0.1 | 1.8 | 1.7 | −0.1 |
| VARIATION IN CONTACT | 0.7 | 0.7 | 0.0 | 0.9 | 0.8 | −0.1 |

*Statistically significant difference at the 95% confidence level.

TABLE 3

SEVEN IRON RESULTS
INDIVIDUAL DIFFERENCES BETWEEN PRE- AND POST-TRAINING TEST SCORES

| IDENTIFICATION NUMBER | Δ AVERAGE DISTANCE | Δ AVERAGE LOCATION | Δ AVERAGE CONTACT |
|---|---|---|---|
| 1 | 2.67 | −0.7 | −.40 |
| 2 | −3.33 | −.27 | −.47 |
| 3 | 2.83 | .19 | −.33 |
| 4 | 4.67 | .20 | −.27 |
| 5 | −11.67 | −.40 | .20 |
| 6 | 3.33 | .13 | −.13 |
| 7 | 0.67 | −1.07 | −1.60 |
| 8 | −9.67 | .27 | −.13 |
| 9 | −12.33 | .13 | −.07 |
| 10 | 1.33 | .20 | −.20 |
| 11 | −22.67 | −.16 | −.27 |
| 12 | −12.67 | .40 | .53 |
| 13 | −29.33 | .63 | .27 |
| 14 | −5.67 | .13 | −.07 |
| 15 | −18.00 | −.53 | .33 |
| 16 | 2.67 | .20 | −.20 |
| 17 | −4.33 | .33 | −.20 |
| 18 | −12.33 | .00 | .27 |
| 19 | −3.67 | .40 | −.53 |
| 20 | −20.00 | .27 | .16 |
| 21 | −24.00 | .67 | .47 |
| 22 | −9.54 | .32 | −.07 |
| 23 | −9.67 | .20 | 1.27 |
| 24 | 20.33 | .07 | −.60 |
| 25 | 4.33 | .07 | −.53 |
| 26 | 29.33 | −.67 | −.67 |
| 27 | −2.67 | .13 | −.27 |
| 28 | −9.00 | .67 | .33 |
| 29 | 0.33 | .47 | .07 |
| 30 | 1.00 | −.47 | .27 |
| 31 | −23.67 | .49 | .53 |
| 32 | −4.67 | .40 | .07 |

TABLE 4

THREE WOOD RESULTS
INDIVIDUAL DIFFERENCES BETWEEN PRE- AND POST-TRAINING TEST SCORES

| IDENTIFICATION NUMBER | Δ AVERAGE DISTANCE | Δ AVERAGE LOCATION | Δ AVERAGE CONTACT |
|---|---|---|---|
| 1 | −2.67 | .00 | .13 |
| 2 | −10.00 | −.33 | .07 |
| 3 | −4.67 | −.27 | .00 |
| 4 | −9.00 | −.07 | −.40 |
| 5 | −11.67 | .33 | .33 |
| 6 | 1.00 | .13 | .07 |
| 7 | −7.33 | .07 | −.20 |
| 8 | 10.11 | .02 | −.60 |
| 9 | −1.67 | .53 | .13 |
| 10 | −7.33 | −.54 | −.40 |
| 11 | −12.33 | −.07 | −.07 |
| 12 | −12.00 | −.13 | −.40 |
| 13 | −35.00 | −.54 | −.27 |
| 14 | −21.00 | .20 | .00 |
| 15 | −14.33 | −.13 | .33 |
| 16 | −15.98 | .28 | .47 |
| 17 | 2.00 | .27 | .00 |
| 18 | 6.00 | .20 | .20 |
| 19 | 4.25 | .05 | −.53 |
| 20 | −19.67 | .20 | .13 |
| 21 | −18.59 | .27 | .40 |
| 22 | 53.00 | −.20 | −.80 |
| 23 | 33.67 | .60 | −1.20 |
| 24 | −10.00 | −.33 | .27 |
| 25 | −6.69 | −.13 | −.53 |
| 26 | 35.33 | −.47 | −.47 |
| 27 | −6.33 | .20 | −.20 |
| 28 | −10.33 | .20 | .00 |
| 29 | 5.00 | −.27 | .00 |
| 30 | −18.00 | −.40 | −.27 |
| 31 | −39.00 | .53 | .33 |
| 33 | −46.00 | .27 | .40 |

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A golf swing training harness for wear by a golfer who has a waist, a leading arm, a following arm and a leading leg during a golf swing comprising:

(a) waist fitting means adapted to be fitted to the waist of the golfer;

(b) elbow means for releaseably securing to an elbow of the following arm of the golfer;

(c) wrist means for releaseably securing to a wrist of the leading arm of the golfer;

(d) adjustable length first elastic means for releaseably securing the elbow means to a first location on the waist fitting means proximate to the following arm; and (e) adjustable length second elastic means for releaseably securing the wrist means to a second location on the waist fitting means proximate to the leading arm.

2. A harness according to claim 1 including an adjustable length leg means for releasably securing to a leading leg of the golfer and adjustable length third elastic means for securing the wrist means to the leg means.

3. A harness according to claim 2 wherein the wrist means, elbow means and leg means are circular.

4. A harness according to claim 3 wherein the circumference of the waist fitting means, elbow means, wrist means and leg means are adjustable.

5. A harness according to claim 4 wherein the elbow means, wrist means and leg means are equipped with hook and pile fasteners.

6. A harness according to claim 2 wherein the waist fitting means is a belt.

7. A harness according to claim 1 wherein the position of securement of the elbow means and the first elastic means to the waist fitting means is moveable.

8. A harness according to claim 7 wherein a diagonal traveller is secured to the waist fitting means and the first elastic means has an end proximate to the wait fitting means that can travel along the length of the traveller and, alternatively, be fixed at a predetermined point on the traveller.

9. A harness according to claim 8 wherein an adjustable length crotch strap is secured to the waist fitting means.

* * * * *